US006068757A

United States Patent [19]

Walker, III

[11] Patent Number: 6,068,757

[45] **Date of Patent: *May 30, 2000**

[54] HYDRODEWAXING PROCESS

[75] Inventor: Benjamin F. Walker, III, Bethel, Pa.

[73] Assignee: Coastal Eagle Point Oil Company, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/552,603

[22] Filed: Nov. 3, 1995

[51] Int. Cl.[7] ..... C10G 47/00; C10G 65/12

[52] U.S. Cl. ..... 208/58; 208/59; 208/27; 208/111.01; 208/89

[58] Field of Search ..... 208/27, 58, 59, 208/111, 89, 111.01

[56] References Cited

U.S. PATENT DOCUMENTS

| | | | |
|---|---|---|---|
| Re. 28,398 | 4/1975 | Chen et al. . | |
| Re. 29,948 | 3/1979 | Dwyer et al. . | |
| 3,140,249 | 7/1964 | Plank et al. . | |
| 3,140,251 | 7/1964 | Plank et al. . | |
| 3,140,252 | 7/1964 | Plank et al. . | |
| 3,140,253 | 7/1964 | Plank et al. . | |
| 3,140,322 | 7/1964 | Frilette et al. . | |
| 3,191,540 | 6/1965 | Skretting . | |
| 3,271,418 | 9/1966 | Plank et al. . | |
| 3,379,640 | 4/1968 | Chen et al. . | |
| 3,395,094 | 7/1968 | Weisz . | |
| 3,700,585 | 10/1972 | Chen et al. . | |
| 3,832,449 | 8/1974 | Rosinski et al. . | |
| 3,852,189 | 12/1974 | Chen et al. . | |
| 3,894,933 | 7/1975 | Owen et al. . | |
| 3,894,938 | 7/1975 | Gorring et al. . | |
| 3,894,939 | 7/1975 | Garwood et al. . | |
| 3,926,782 | 12/1975 | Plank et al. . | |
| 3,954,671 | 5/1976 | White . | |
| 3,956,102 | 5/1976 | Chen et al. . | |
| 3,968,024 | 7/1976 | Gorring et al. . | |
| 3,985,050 | 10/1976 | Lurie . | |
| 4,016,245 | 4/1977 | Plank et al. . | |
| 4,046,859 | 9/1977 | Plank et al. . | |
| 4,067,797 | 1/1978 | Chen et al. . | |
| 4,076,842 | 2/1978 | Plank et al. . | |
| 4,113,656 | 9/1978 | Riley et al. . | |
| 4,192,734 | 3/1980 | Pavlica et al. . | |
| 4,292,166 | 9/1981 | Gorring et al. | 208/59 |
| 4,347,121 | 8/1982 | Mayer et al. | 208/59 |
| 4,446,007 | 5/1984 | Smith . | |
| 4,597,854 | 7/1986 | Penick | 208/58 |
| 4,720,337 | 1/1988 | Graziani et al. | 208/59 |
| 4,810,356 | 3/1989 | Grootjans et al. | 208/59 |
| 4,908,120 | 3/1990 | Bowes et al. | 208/59 |
| 4,913,797 | 4/1990 | Albinson et al. | 208/89 |
| 4,921,593 | 5/1990 | Smith | 208/59 |
| 4,935,120 | 6/1990 | Lipinski et al. | 208/59 |
| 4,994,170 | 2/1991 | Lipinski et al. | 208/59 |
| 5,246,568 | 9/1993 | Forbus et al. | 208/59 |

*Primary Examiner*—Walter D. Griffin
*Attorney, Agent, or Firm*—Browning Bushman

[57] ABSTRACT

A process for catalytic hydrodewaxing of a wax-containing feed wherein the feed is subjected to hydrodewaxing conditions in a first reaction zone containing a wax-cracking catalyst, the effluent from the first reaction zone is charged to a second reaction zone containing a hydrotreating catalyst that produces an exothermic reaction and the effluent from the second reaction zone is charged to a third reaction zone containing a wax-cracking catalyst, the exothermic reaction in the second reaction zone effecting heating of the effluent, which is charged to the third reaction zone.

22 Claims, 1 Drawing Sheet

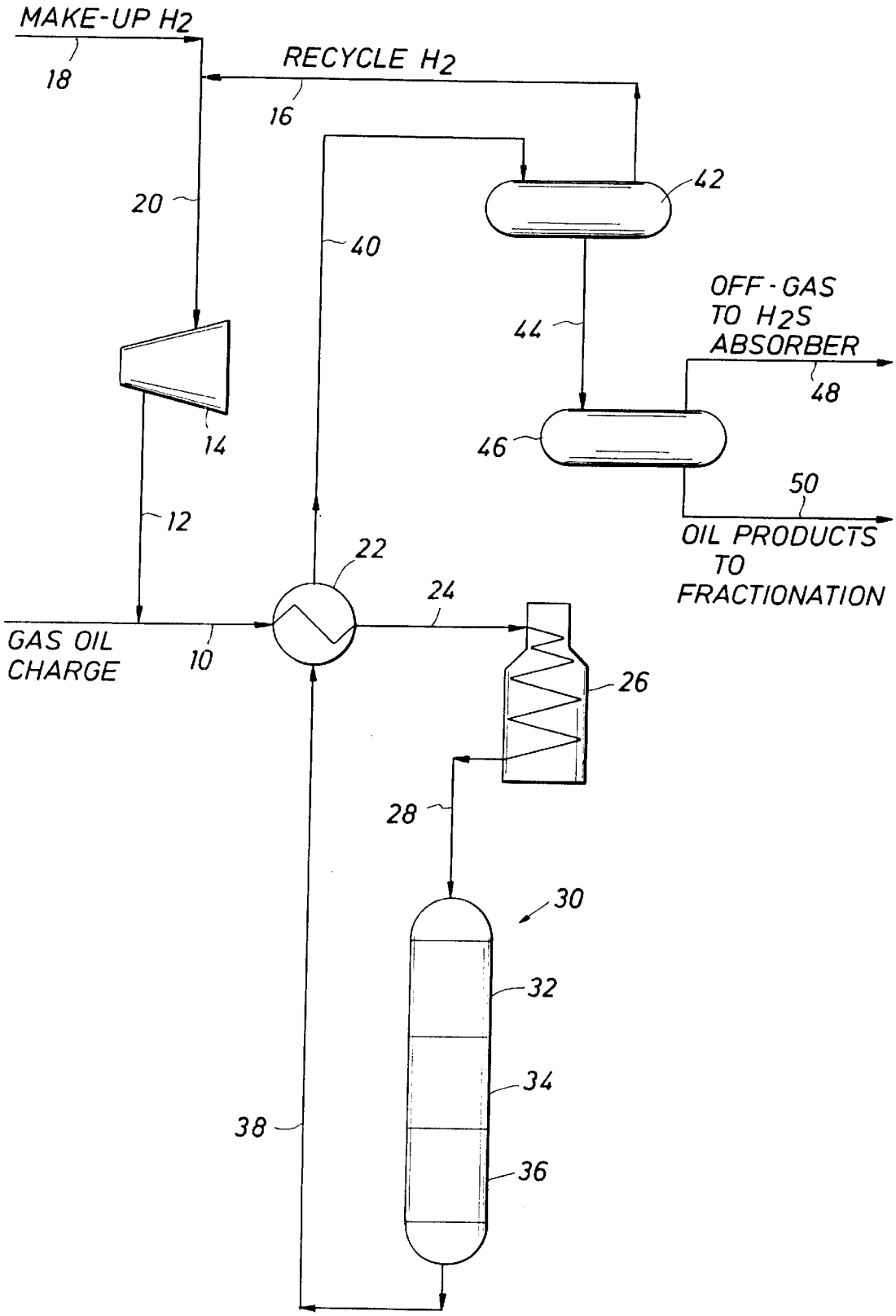
MAKE-UP H2
18
RECYCLE H2
16
20
40
42
44
OFF-GAS
TO H2S
ABSORBER
48
14
46
50
12
OIL PRODUCTS
TO
FRACTIONATION
22
24
GAS OIL
CHARGE
10
26
28
30
32
34
38
36

HYDRODEWAXING PROCESS

BACKGROUND OF THE INVENTION

1. Field of the Invention

The present invention relates to wax hydrocracking and, more specifically, to hydrodewaxing using shape-selective zeolites.

2. Description of the Prior Art

As evidenced by the patent and scientific literature, it is well known that crystalline zeolite catalyst are widely used in various hydrocarbon conversion processes. Crystalline aluminosilicates have been found to be particularly effective for a wide variety of hydrocarbon conversion processes and have been described and claimed in many patents, including U.S. Pat. Nos. 3,140,249; 3,140,252; 3,140,251; 3,140,253; and 3,271,418. Aside from being general catalysts and hydrocarbon conversion processes, it is also known that the molecular sieve properties of zeolites can be utilized to preferentially convert one molecular species from a mixture of the same with other species.

In a process of this type, a zeolite molecular sieve is employed having catalytic activity within its internal pore structure and pore openings such that one component of a feed is capable of entering within the internal pore structure thereof and being converted to the substantial exclusion of another component that, because of its size, is incapable of entering within the pores of the zeolitic material. Such shape-selective catalytic conversion is also known in the art and is disclosed and claimed in U.S. Pat. Nos. 3,140,322; 3,379,640; and 3,395,094.

Recently, attention has focused on a novel class of catalysts useful in the dewaxing of gas oils, lube base stocks, kerosenes, and whole crudes, including syncrudes obtained from shale, tar sands, and coal hydrogenation. U.S. Pat. No. 3,700,585 discloses the use of ZSM-5 zeolite to efficiently catalyze dewaxing of various petroleum feedstocks. U.S. Pat. No. 3,700,585 discloses and claims the cracking and hydrocracking of paraffinic materials from various hydrocarbon feedstocks. The patent is based upon work on the dewaxing of gas oils, particularly virgin gas oils, and crudes, although its disclosure and claims are applicable to the dewaxing of any mixture of straight chain, slightly branched chain, and other configuration hydrocarbons. The catalyst may have a hydrogenation/dehydrogenation component incorporated therein. Other U.S. Patents teaching dewaxing of various petroleum stocks are U.S. Pat. Nos. Re. 28,398; 3,852,189; 3,191,540; 3,894,933; 3,894,938; 3,894,939; 3,926,782; 3,956,102; 3,968,024; 3,985,050; 4,067,797; and 4,192,734.

Catalytic hydrodewaxing can be considered a relatively mild, shape-selective cracking or hydrocracking process. It is shape-selective because of the inherent constraints of the catalyst pore size upon the molecular configurations that are converted. It is mild because the conversion of gas oil feed to lower boiling range products is limited, e.g., usually below about 35%, and more usually below about 25%. It is operative over a wide temperature range but is usually carried out at relatively low temperatures, e.g., start of run temperatures of from about 270° C. are usual. Generally speaking, shape-selective catalytic hydrodewaxing is usually conducted in a single stage, "single stage" meaning that the dewaxing is customarily conducted in one large reactor, or in several reactors in series, with no intermediate heating, cooling, removal of impurities, etc., between reactor beds. This is to be contrasted to conventional hydrocracking processes, which usually operate in several stages with one or more quench stages to prevent temperature runaway.

In U.S. Pat. No. 4,446,007, there is disclosed a shape-selective catalytic hydrodewaxing process wherein the reaction temperature is raised relatively rapidly to at least about 360° C. after start-up. While the process disclosed in U.S. Pat. No. 4,446,007 (incorporated herein by reference for all purposes) gives an optimum start-up, it does not provide optimum operation of the process thereafter; i.e., while the rapid start-up procedure makes the dewaxing unit an efficient generator of high octane gasoline during start-up, it does not solve the problem of working the catalyst to the maximum extent possible or extending the run length. The latter problem was solved by the processes disclosed in U.S. Pat. Nos. 4,935,120 and 4,994,170.

In the process disclosed in U.S. Pat. No. 4,935,120 (incorporated herein by reference for all purposes), hydrocracking the wax was accomplished in at least a first stage reaction zone and at least a second stage reaction zone, the effluent from the first stage being heated and charged to the second stage reaction zone.

In the process disclosed in U.S. Pat. No. 4,994,170 (incorporated herein by reference for all purposes), hydrocracking the wax was accomplished in two stages, with the first stage containing at least 20 wt % of the dewaxing catalyst and the second stage containing at least 20 wt % of the dewaxing catalyst, there being added at least a portion of the hydrogen downstream of the first stage, the total hydrogen to the second stage being greater than the total hydrogen to the first stage.

It is known that certain catalysts are useful in "hydrotreating processes" wherein a hydrocarbon feed is contacted with the catalyst in the presence of hydrogen and under selected conditions to remove heteroatoms such as sulfur, nitrogen, oxygen, and metallic contaminants such as nickel, vanadium, and iron from the feed and/or to saturate aromatic hydrocarbons and/or olefinic hydrocarbons in the feedstock and/or to hydrocrack the feedstock. For example, U.S. Pat. No. 4,113,656 (incorporated herein by reference for all purposes) discloses hydrotreating catalysts comprising at least one Group VIB metal component and at least Group VIII metal component that are ideally suited for such hydrotreating processes. U.S. Pat. No. 3,954,671 (incorporated herein by reference for all purposes) discloses a hydrotreating catalyst comprising a co-gelled composition comprising a crystalline zeolitic molecular sieve component containing less than 5 wt % sodium and containing ions selected from Mn, rare earths of atomic numbers 58–71 and alkaline earths, the catalyst further comprising an alumina-containing gel component, a Group VI hydrogenating component, and a Group VIII hydrogenating component.

SUMMARY OF THE INVENTION

It is therefore an object of the present invention to provide an improved hydrodewaxing process.

The above and other objects of the present invention will become apparent from the drawings, the description given herein, and the appended claims.

In a typical catalytic hydrodewaxing process, a wax-containing feed is contacted in a reactor with hydrogen in the presence of a shape-selective zeolite wax-cracking catalyst under hydrodewaxing conditions to produce a dewaxed product stream. According to the improved process of the present invention, the wax is hydrocracked in at least a first stage reaction zone containing the wax-cracking catalyst; the effluent from the first stage reaction zone is charged to a second stage reaction zone containing a hydrotreating catalyst that produces an exothermic reaction; and the effluent from the second stage reaction zone is charged to a third stage reaction zone containing the wax-cracking catalyst such that the effluent from the second stage reaction zone is heated prior to being charged to the third stage reaction zone.

BRIEF DESCRIPTION OF THE DRAWINGS

The single FIGURE is a simplified, schematic view of the dewaxing process of the present invention.

DESCRIPTION OF THE PREFERRED EMBODIMENTS

In conducting the process of the present invention, any waxy material that has heretofore been processed in shape-selective catalytic dewaxing processes can be used. This includes gas oils, lube stocks, kerosenes, whole crudes, synthetic crudes, tar sand oils, shale oils, etc. These heavy feeds may be subjected to one or more conventional pre-treatment steps, such as hydrotreating, to remove excessive amounts of nitrogen impurities, metals, etc.

The preferred charge stocks are gas oils and vacuum gas oils derived from paraffinic crudes. Gas oils contemplated for use herein will have boiling ranges of 350–850° F., while vacuum oils generally have boiling ranges of 500–900° F. Pour points of generally 75–100° F., or more, and frequently 85–90° F., with cloud points perhaps 5° F. above the pour point.

The feed preferably is slightly heavier, re end point, than the specification end point of the desired product. This is somewhat heavier than the conventional feed (usually an atmospheric gas oil) to shape-selective catalysts dewaxing units making fuel oil products. Some light vacuum gas oil, or material boiling in this range, is preferably present in the feed.

The dewaxing process can convert some feeds boiling beyond the diesel or No. 2 fuel oil boiling range into materials boiling within the desired range. The dewaxing process used herein is not an efficient converter of heavy feeds to lighter feeds and will leave some fractions of the feed (primarily the aromatic and naphthenic fractions) relatively untouched; thus, although these non-paraffinic materials can be tolerated in the feed, they are not efficiently converted by the shape-selective zeolite catalyst. A relatively heavy feed, with product end point specifications satisfied by downstream fractionation, maximizes production of more valuable light products from less valuable heavy feed.

The shape-selective zeolites that can be used in the hydrocracking or hydrodewaxing beds are those that are typically used to crack normal paraffins in a heavy hydrocarbon stream. Suitable zeolites and their properties are disclosed in U.S. Pat. No. 4,446,007. As disclosed in U.S. Pat. No. 4,446,007, the preferred zeolites have a Constraint Index of 1–12. Of the zeolite materials useful in the present process, zeolites ZSM-5, ZSM-11, ZSM-12, ZSM-23, ZSM-35, ZSM-38, and ZSM-48 are noted. ZSM-5, described in U.S. Pat. Nos. 3,702,886 and Re. 29,948, each of which is incorporated herein by reference for all purposes, is preferred. Highly useful zeolites include ZSM-12, described in U.S. Pat. No. 3,832,449, incorporated herein by reference for all purposes, and ZSM-23, described in U.S. Pat. No. 4,076,842, incorporated herein by reference for all purposes. U.S. Pat. Nos. 4,016,245, and 4,046,859, describing ZSM-35 and ZSM-38, respectively, are incorporated herein by reference for all purposes.

The operating conditions in the catalytic dewaxing reaction zones and the hydrotreating reaction zone(s) are broadly within those conditions heretofore found suitable for shape-selective catalyst hydrodewaxing, such conditions being well known to those skilled in the art. More details of preferred conditions are recited in U.S. Pat. No. 4,446,007. In general, the shape-selective catalytic dewaxing and hydrotreating occurs at temperatures from about 316–454° C. (600–850° F.), at LHSVs ranging from 0.1–10. Preferred conditions include a temperature of at least about 360° C. Pressures are usually mild, typically on the order of prior art hydrotreating processes ranging from about 100–1000 psig. Operating pressures of about 400 lbs. of hydrogen-partial pressure have been found to give good results. As per the teachings of U.S. Pat. Nos. 4,935,120 and 4,994,170, heating the first stage hydrodewaxing effluent by the addition of hot hydrogen and/or distributing a portion of the hydrogen downstream of the first stage, dewaxing reaction zone such that the total hydrogen to the second stage, dewaxing reaction zone is greater than the total hydrogen to the first stage can also be employed in the improved process of the present invention.

The process of the present invention is generally conducted in a single stage in the sense that there is no intermediate heating, cooling, removal of impurities, etc., between reactor beds as is done in conventional hydrocracking processes, all of which typically involve one or more quench stages to control temperature. It is to be understood that the single stage process of the present invention can be conducted in a single large reactor vessel or in several reactors in series: i.e., the first, second, and third stage reaction zones could all be in the same reactor vessel, the first and second stage reaction zones could be in one vessel and the third stage reaction zone in another vessel, all of the zones could be in separate vessels, etc. In all such cases, however, there would be no intermediate quenching of the effluent as it flowed from one reaction stage to the next reaction stage. Thus, while the process can be conducted in three, four, or even more reactors, depending on the number of stages employed, in general the benefits gained by such an elaborate reactor design are not offset by the increased costs associated therewith.

It will be appreciated that while, in a typical case, the process of the present invention will be carried out with two hydrodewaxing stages having the hydrotreating stage sandwiched therebetween, additional hydrodewaxing and/or hydrotreating reaction stages can be employed. When two hydrodewaxing stages are employed with an intermediate hydrotreating stage, it has been found desirable to distribute the hydrodewaxing catalyst between the two stages such that at least 20% by weight of the dewaxing catalyst is in the first stage dewaxing zone and at least 20% of the dewaxing catalyst is in the second stage dewaxing zone (third stage reaction zone, as described herein). Preferably, about 30–50% by weight of the total dewaxing catalyst will be in the first stage dewaxing zone, with the remaining 50–70% of the dewaxing catalyst in the second stage dewaxing zone (third stage reaction zone, as described herein).

Basically, then, the thrust of the present invention is to use at least two reaction zones containing shape-selective zeolite catalysts for hydrodewaxing of the feed, the two dewaxing zones being separated by a hydrotreating zone containing a hydrotreating catalyst that interacts with the effluent from the first stage dewaxing zone to produce an exothermic reaction, thereby heating the effluent from the first stage dewaxing zone such that the temperature of the feed introduced into the second stage dewaxing zone is greater than the temperature of the effluent from the first stage reaction zone.

The catalyst used in the reaction zone containing the hydrotreating catalyst that produces an exothermic reaction (second stage reaction zone, as described herein) can be any hydrotreating catalyst that (a) interacts with the effluent from a dewaxing reaction zone to produce an exothermic reaction and (b) does not deleteriously affect subsequent hydrodewaxing. As noted, typical of such catalyst that can be used in the hydrotreating reaction zone are disclosed in U.S. Pat. Nos. 4,113,656 and 3,954,671, both of which are incorporated herein by reference. As used herein, a "hydrotreating catalyst" is a catalyst that, when contacted by a hydrocarbon feed in the presence of hydrogen and under appropriate conditions, can remove heteroatoms, such as sulfur, nitrogen, and oxygen, and metal contaminants, such as nickel, vanadium, and iron from the feedstock and/or saturate aromatic hydrocarbon and/or olefinic hydrocarbons in the feedstock and/or hydrocrack the feedstock. Such hydrotreating catalysts typically employ a substrate such as alumina composited with a hydrogenation component. For example, the hydrogenation component can be comprised of at least one Group VIB metal component and at least one Group VIII metal component. The Group VIB metal component can be selected from the group consisting of at least one elemental metal, metal oxide, or metal sulfide of a Group VIB element of the Periodic Table of Elements and at least one Group VIII metal component selected from the group consisting of at least one elemental metal, metal oxide, or metal sulfide of a Group VIII metal of the Period Table of Elements. One such commercially available catalyst that is useful in the hydrotreating reaction zone of the present invention is marketed under the trade name CRITERION 448 by Criterion Catalyst Company L. P. CRITERION 448 is described as a high activity cobalt/molybdenum catalyst on an extruded alumina base. It will be apparent to those skilled in the art that other, commercially available hydrotreating catalysts can also be employed.

In conducting the process of the present invention, and with particular respect to the hydrotreating reaction stage, it is desired that the hydrotreating catalyst and process conditions be such that the effluent from the hydrotreating zone is heated to a temperature sufficient to increase the average bed temperature of a subsequent dewaxing reaction zone by 30–50° F. or the entire reaction zone comprised of the dewaxing reaction zones and the hydrotreating zone from 25–35° F. Typically, the effluent from the first stage dewaxing reaction zone will have a temperature of from about 730° F. to about 760° F., whereas the temperature of the effluent from the hydrotreating zone will have a temperature of from about 770° F. to about 800° F.

The present invention can be better understood with reference to the FIGURE, which shows a considerably simplified process flow diagram of one embodiment of the invention.

With reference to the FIGURE, a feedstock, e.g., gas oil charge, in line 10 is admixed with hydrogen in line 12, the hydrogen in line 12 passing from compressor 14 and being comprised of recycled hydrogen from line 16 and make-up hydrogen from line 18, both of those streams being combined and introduced into compressor 14 via line 20. The combined gas oil charge/hydrogen mixture is passed through heat exchanger 22 and introduced via line 24 into heater 26. The heated mixture is charged via line 28 into the reactor shown generally as 30.

Reactor 30 has disposed therein a first bed 32, a second bed 34, and a third bed 36. Bed 32 contains a typical dewaxing catalyst such as described above, bed 34 contains a typical hydrotreating catalyst as described above, and bed 36 contains a typical dewaxing catalyst described above. As the feed passes through reactor 30, hydrodewaxing occurs in beds 32 and 36 while hydrodesulfurization or some similar hydrotreating reaction occurs in bed 34. The dewaxed heavy feed, cracked products, and hydrogen are removed from reactor 30 via line 38, passed through heat exchanger 22, and introduced via line 40 into high pressure separator 42.

High pressure separator 42 generally operates at a temperature of 60–130° F. and pressure of 500–540 psig. As shown, a hydrogen-rich gas stream is withdrawn from high pressure separator 42 via line 16 and used for recycle as previously described. It will be understood that the hydrogen-rich stream withdrawn via line 16 from high pressure separator 42 can be removed as a fuel gas by-product, recycled to mix with fresh feed as shown, or used, in a manner not shown, to heat the effluent from bed 32 in reactor 30.

Liquid is removed from high pressure separator 42 via line 44 and discharged into low pressure separator 46, generally operating at a temperature of 60–130° F. under pressure of 175–180 psig. The off-gas from low pressure separator 46, generally comprised of $C_4$ and lighter hydrocarbons, is removed via line 48 and sent to an $H_2S$ absorber. A liquid stream is removed from low pressure separator 46 via line 50 and sent for fractionation and further downstream processing.

EXAMPLE

The feedstock used is a gas oil feed having the following characteristics:

TABLE 1

| LV % | TBP, ° F. |
|---|---|
| IBP | 386 |
| 5 | 531 |
| 10 | 585 |
| 30 | 639 |
| 50 | 676 |
| 70 | 722 |
| 90 | 800 |
| 95 | 849 |
| EP | 900 |
| ° API | 34.1 |
| Cloud Point, ° F. | 95 |
| Pour Point, ° F. | 90 |
| Sulfur, Wt % | 0.26 |

The make-up hydrogen has the following composition:

TABLE 2

| Component | Mole % |
|---|---|
| $H_2$ | 80.1 |
| $C_1$ | 7.0 |
| $C_2$ | 5.4 |
| $C_3$ | 3.4 |
| $iC_4$ | 0.6 |
| $nC_4$ | 0.7 |
| $iC_5$ | 0.2 |
| $nC_5$ | 0.1 |
| $C_6$+ | 2.5 |
| Total | 100.0 |
| MW | 7.5 |

The above feed is charged to a reactor containing a first stage hydrodewaxing reaction zone, a second stage hydrotreating reaction zone, and a third stage hydrodewaxing zone in the process scheme shown in the FIGURE and described above. The hydrotreating catalyst employed is Criterion 448, which is basically a hydrodesulfurization catalyst. The physical properties of the products produced are shown in Table 3 below:

TABLE 3

A. Off-Gas

| Component | Mole % |
|---|---|
| $H_2$ | 32.8 |
| $H_2S$ | 2.1 |
| $NH_3$ | 0.7 |
| $C_1$ | 17.9 |
| $C_2$= | 2.4 |
| $C_2$ | 6.3 |
| $C_3$= | 9.6 |
| $C_3$= | 14.5 |
| $C_4$= | 6.7 |
| $iC_4$ | 1.9 |
| $nC_4$ | 3.7 |
| $C_5$+ | 1.4 |
| Total | 100.0 |
| MW | 25.6 |

B. LPG's Produced at 11.2 Wt % Based on Gas Oil Charge

| Component | LV % |
|---|---|
| $C_2$and lighter | 4.6 |
| $C_3$'s | 34.0 |
| $C_4$'s | 57.2 |
| $C_5$'s | 4.2 |
| MW, dry | 50.7 |
| ° API | 124.4 |

C. Naphtha Produced at 24.3 Wt % Based on Gas Oil Charge

| LV % | D86, ° F. |
|---|---|
| IBP | 80 |
| 5 | 116 |
| 10 | 117 |
| 30 | 122 |
| 50 | 160 |
| 70 | 205 |
| 90 | 268 |
| 95 | 290 |
| EP | 323 |
| ° API | 71.6 |

D. Diesel Produced at 37.2 Wt % Based on Gas Oil Charge

| LV % | TBP,° F. |
|---|---|
| IBP | 312 |
| 5 | 450 |
| 10 | 550 |
| 30 | 594 |
| 50 | 623 |
| 70 | 647 |
| 90 | 680 |
| 95 | 695 |
| EP | 710 |
| °API | 31.2 |
| Cloud Point, ° F. | 10 |
| Pour Point, ° F. | 0 |
| Sulfur, Wt % | 0.04 |

D. Gas Oil Produced at 26.1 Wt % Based on Gas Oil Charge

| LV % | TBP, ° F. |
|---|---|
| IBP | 583 |
| 5 | 631 |
| 10 | 649 |
| 30 | 690 |
| 50 | 719 |
| 70 | 751 |
| 90 | 803 |
| 95 | 837 |
| EP | 893 |
| °API | 26.9 |

It is found that by using the process of the present invention, there is produced a smaller fraction of hydrodewaxing bottoms and a higher fraction of hydrodewaxed diesel, naphtha, and butanes. Additionally, the diesel, naphtha, and butanes produced are found to be essentially free of sulfur, other than a relatively small amount of mercaptans.

By using the process of the present invention, there is thus produced a high quality, low pour point, low sulfur diesel fuel directly from the hydrodewaxing unit. Additionally, since the process increases the average bed temperature of the second dewaxing bed or the entire average bed temperature, i.e., across two dewaxing beds and the hydrotreating bed, the following benefits are achieved:

1. The normal feed charge rate can be doubled for the same cycle length.

2. The cycle length can be increased by 14 weeks, and energy consumption of the unit can be lowered by 17.2 FOEB/d at 11,000 b/d 3. Alternatively, the same levels of hydrodewaxing can be achieved using one-half of the normal hydrodewaxing catalyst charge.

Since the hydrotreating catalyst also effects denitrification of basic nitrogen components in the feed, the overall performance of the hydrodewaxing unit is improved.

The foregoing disclosure and description of the invention is illustrative and explanatory thereof, and various changes in the method steps may be made within the scope of the appended claims without departing from the spirit of the invention.

What is claimed is:

1. In a process for catalytic hydrodewaxing of a wax-containing feed in a reactor by contacting said feed with hydrogen in the presence of a catalyst comprising a shape-selective zeolite wax-cracking catalyst under hydrodewaxing conditions to produce a dewaxed product stream, the improvement comprising hydrocracking the wax in said feed in at least a first reaction zone containing said wax-cracking catalyst, charging the effluent from said first reaction zone to a second reaction zone containing a hydrotreating catalyst that produces an exothermic reaction and hydrotreating said effluent from said first reaction zone, and charging the effluent from said second reaction zone to at least a third reaction zone containing said wax cracking catalyst and hydrocracking said wax, whereby the effluent from said second reaction zone is heated via the exothermic reaction in said second zone prior to being charged to said third reaction zone so as to increase the average temperature in said third reaction zone by 30–50° F. and wherein said process is conducted in a single stage without any intermediate heating, cooling, or separation steps.

2. The process of claim 1 wherein said hydrocracking in said first and third reaction zones is conducted at a temperature of 316–454° C.

3. The process of claim 2 wherein said hydrocracking in said first and third reaction zones is conducted at a temperature in excess of about 360° C.

4. The process of claim 1 wherein said wax-cracking catalyst has a silica to alumina mol ratio of at least 12, said hydrocracking in said first and third reaction zones being conducted at a temperature of 316–454° C., a liquid hourly space velocity of about 0.2 to 10, a reactor pressure of about 100 psig to 3000 psig and a hydrogen to hydrocarbon mol ratio greater than 0 to about 20.

5. The process of claim 1 wherein said wax-cracking catalyst has a silica to alumina mol ratio of at least 12, wherein said hydrocracking in said first and third reaction zones is conducted at a temperature above about 360° C., a liquid hourly space velocity of about 0.2 to 10, a reactor pressure of about 100 psig to 3000 psig and a hydrogen to hydrocarbon mol ratio greater than 0 to about 20.

6. The process of claim 1 wherein said zeolite is selected from the group consisting of ZSM-5, ZSM-11, ZSM-12, ZSM-23, ZSM-35, ZSM-38, and ZSM-48.

7. The process of claim 1 wherein said hydrotreating catalyst comprises an alumina support compacted with a hydrogenation component comprising at least one Group VIB metal component and at least one Group VIII metal component.

8. The process of claim 7 wherein said Group VIB metal component is selected from the group consisting of at least one elemental metal, metal oxide, or metal sulfide of a Group VIB element of the Periodic Table of Elements and said Group VIII metal component is selected from the group consisting of at least one elemental metal, metal oxide, or metal sulfide of a Group VIII metal of the Periodic Table of Elements.

9. The process of claim 1 wherein at least 20% of the total inventory of wax cracking catalyst is in the first reaction zone and at least 20% of the total inventory of wax-cracking catalyst is in the third reaction zone.

10. The process of claim 1 wherein about 30–50% by weight of the total inventory of wax cracking catalyst is in the first reaction zone and 50–70% of the wax cracking catalyst is in the third reaction zone.

11. The process of claim 1 wherein said hydrotreating is conducted at a temperature of 30–50° F. higher than the temperature of said effluent from said first reaction zone.

12. In a process for catalytic hydrodewaxing of a wax-containing feed in a reactor by contacting said feed with hydrogen in the presence of a catalyst comprising a shape-selective zeolite wax-cracking catalyst under hydrodewaxing conditions to produce a dewaxed product stream, the improvement comprising hydrocracking the wax in said feed in at least a first reaction zone containing said wax-cracking catalyst, charging the effluent from said first reaction zone to a second reaction zone containing a hydrotreating catalyst that produces an exothermic reaction and hydrotreating said effluent from said first reaction zone, charging the effluent from said second reaction zone to at least a third reaction zone containing said wax cracking catalyst and hydrocracking said wax, and recovering a composition comprising a low sulfur-containing diesel fuel from said third reaction zone whereby the effluent from said second reaction zone is heated via the exothermic reaction in said second zone prior to being charged to said third reaction zone so as to increase the average temperature in said third reaction zone by 30–50° F. and wherein said process is conducted in a single stage without any intermediate heating, cooling, or separation steps.

13. The process of claim 12 wherein said hydrocracking in said first and third reaction zones is conducted at a temperature of 316–454° C.

14. The process of claim 12 wherein said hydrocracking in said first and third reaction zones is conducted at a temperature in excess of about 360° C.

15. The process of claim 12 wherein said wax-cracking catalyst has a silica to alumina mol ratio of at least 12, said hydrocracking in said first and third reaction zones being conducted at a temperature of 316–454° C., and liquid hourly space velocity of about 0.2 to 10, a reactor pressure of about 100 psig to 3000 psig and a hydrogen to hydrocarbon mol ratio greater than 0 to about 20.

16. The process of claim 12 wherein said wax-cracking catalyst has a silica to alumina mol ratio of at least 12, wherein said hydrocracking in said first and third reactions zones is conducted at a temperature above about 360° C., a liquid hourly space velocity of about 0.2 to 10, a reactor pressure of about 100 psig to 3000 psig, and a hydrogen to hydrocarbon mol ratio greater than 0 to about 20.

17. The process of claim 12 wherein said zeolite is selected from the group consisting of ZSM-5, ZSM-11, ZSM-12, ZSM-23, ZSM-35, ZSM-38, and ZSM-48.

18. The process of claim 12 wherein said hydrotreating catalyst comprises an alumina support compacted with a hydrogenation component comprising at least one Group VIB metal component and at least one Group VIII metal component.

19. The process of claim 18 wherein said Group VIB metal component is selected from the group consisting of at least one elemental metal, metal oxide, or metal sulfide of a Group VIB element of the Periodic Table of Elements and said Group VIII metal component is selected from the group consisting of at least one elemental metal, metal oxide, or metal sulfide of a Group VIII metal of the Periodic Table of Elements.

20. The process of claim 12 wherein at least 20% of the total inventory of wax cracking catalyst is in the first reaction zone and at least 20% of the total inventory of wax cracking catalyst is in the third reaction zone.

21. The process of claim 12 wherein about 30–50% by weight of the total inventory of wax cracking catalyst is in the first reaction zone and 50–70% of the wax cracking catalyst is in the third reaction zone.

22. The process of claim 12 wherein said hydrotreating is conducted at a temperature of 30–50° F. higher than the temperature of said effluent from said first reaction zone.

* * * * *